US009980061B2

(12) United States Patent
Botz et al.

(10) Patent No.: US 9,980,061 B2
(45) Date of Patent: May 22, 2018

(54) WIRELESS ELECTRONIC DEVICE WITH ORIENTATION-BASED POWER CONTROL

(71) Applicant: Starkey Laboratories, Inc., Eden Prairie, MN (US)

(72) Inventors: Alexander Botz, Minnetonka, MN (US); Joseph Edward Bange, Eagen, MN (US); Bret Hassler, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days. days.

(21) Appl. No.: 14/932,880

(22) Filed: Nov. 4, 2015

(65) Prior Publication Data

US 2017/0127195 A1 May 4, 2017

(51) Int. Cl.

*H04R 3/00* (2006.01)
*H04R 25/00* (2006.01)
*H04R 29/00* (2006.01)

(52) U.S. Cl.

CPC ..... *H04R 25/554* (2013.01); *H04R 29/004* (2013.01); *H04R 25/305* (2013.01); *H04R 2225/51* (2013.01); *H04R 2460/03* (2013.01)

(58) Field of Classification Search

CPC ..... H04R 25/554; H04R 25/558; H04R 2225/55; H04R 25/552; H04R 25/70; H04R 2225/41; H04R 2420/07; H04R 25/43; H04R 2225/61; H04R 2460/03; H04R 25/505; H04R 1/1091; H04R 2225/43

USPC ..... 381/315, 355, 58, 77, 323

See application file for complete search history.

(56) References Cited

U.S. PATENT DOCUMENTS

| | | | | |
|---|---|---|---|---|
| 8,045,727 | B2 | 10/2011 | Philipp | |
| 8,417,296 | B2 | 4/2013 | Caballero et al. | |
| 2011/0194230 | A1* | 8/2011 | Hart | H04M 1/185 361/437 |
| 2012/0214422 | A1 | 8/2012 | Shi et al. | |
| 2013/0163798 | A1* | 6/2013 | Ozden | H04R 25/554 381/315 |
| 2013/0172045 | A1* | 7/2013 | Caballero | H04B 1/3838 455/552.1 |

(Continued)

FOREIGN PATENT DOCUMENTS

| | | | |
|---|---|---|---|
| CN | 203368749 | U | 12/2013 |
| CN | 204482003 | U | 7/2015 |

(Continued)

OTHER PUBLICATIONS

"European Application Serial No. 16197133.8, Extended European Search Report dated Apr. 7, 2017", 7 pgs.

*Primary Examiner* — Md S Elahee
*Assistant Examiner* — Julie X Dang
(74) *Attorney, Agent, or Firm* — Schwegman Lundberg & Woessner, P.A.

(57) ABSTRACT

A hearing aid may utilize a companion microphone, separate from the hearing aid itself, for improving the understanding of speech spoken by a particular person or produced by a particular sound source. The companion microphone is a battery-powered hearing aid accessory device that picks up ambient sound and transmits corresponding radio signals to the hearing aid. Described herein are schemes help to preserve battery life in a companion microphone by using adaptive radio transmission power control.

20 Claims, 7 Drawing Sheets

(56) References Cited

U.S. PATENT DOCUMENTS

| | | | | |
|---|---|---|---|---|
| 2014/0098073 | A1 | 4/2014 | Singh et al. | |
| 2014/0169599 | A1* | 6/2014 | Solum | H04R 25/554 381/315 |
| 2014/0176297 | A1* | 6/2014 | Mulder | G09B 21/009 340/4.14 |
| 2014/0266939 | A1* | 9/2014 | Baringer | H01Q 21/28 343/729 |
| 2014/0355799 | A1* | 12/2014 | Rasmussen | H04R 25/554 381/315 |

FOREIGN PATENT DOCUMENTS

| | | | |
|---|---|---|---|
| EP | 2838210 | A1 | 2/2015 |
| WO | WO-2009049646 | A1 | 4/2009 |

* cited by examiner

WIRELESS ELECTRONIC DEVICE WITH ORIENTATION-BASED POWER CONTROL

FIELD OF THE INVENTION

This invention pertains to electronic hearing aids, hearing aid systems, and methods for their use.

BACKGROUND

Hearing aids are electronic instruments that compensate for hearing losses by amplifying sound. A hearing aid may utilize a companion microphone, separate from the hearing aid itself, for improving the understanding of speech spoken by a particular person or produced by a particular sound source. The companion microphone is a hearing aid accessory device that picks up ambient sound and transmits corresponding radio signals to the hearing aid. The companion microphone may be designed to be worn by a companion of the hearing aid user or placed on a stationary structure such as tabletop. The radio transmission power level required by the companion microphone may differ in these two scenarios. Efficiently managing the radio transmission power level of companion microphones or other similar devices is the primary concern of this disclosure.

DETAILED DESCRIPTION

Figure 1:
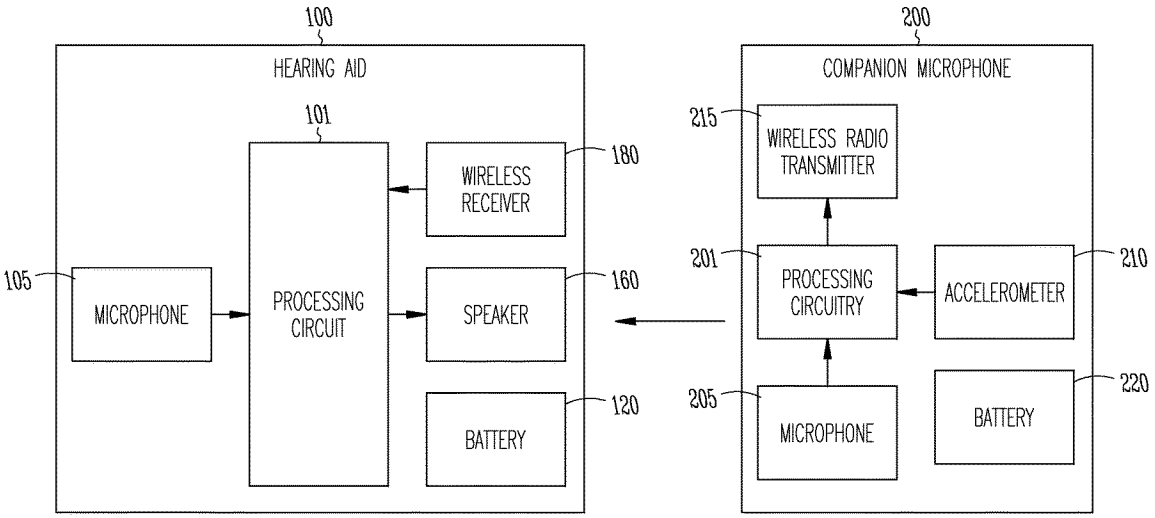
FIG. 1 shows the basic electronic components of an example hearing aid and companion microphone.

The electronic components of a hearing aid may include a microphone for receiving ambient sound, processing circuitry for amplifying the microphone signal in a manner that depends upon the frequency and amplitude of the microphone signal, a speaker for converting the amplified microphone signal to sound for the wearer, and a battery for powering the components. FIG. 1 illustrates the basic functional components of an example hearing aid 100. The electronic circuitry of the hearing aid is contained within a housing that may be placed, for example, in the external ear canal or behind the ear. A microphone 105 receives sound waves from the environment and converts the sound into an input signal. The input signal is then amplified by preamplifier and sampled and digitized by an A/D converter to result in a digitized input signal. The device's processing circuitry 101 (e.g., a digital signal processor or DSP) processes the digitized input signal into an output signal in a manner that compensates for the patient's hearing deficit. The processing circuitry 101 (as well as the processing circuitry 201 of the companion microphone described below) may be implemented in a variety of different ways, such as with an integrated digital signal processor or with a mixture of discrete analog and digital components that include a processor executing programmed instructions contained in a memory. The output signal is then passed to an audio output stage that drives speaker 160 (also referred to as a receiver) to convert the output signal into an audio output. Also shown in FIG. 1 is a wireless receiver 180 interfaced to the hearing aid's processing circuitry for receiving radio signals transmitted by a companion microphone 200. The wireless receiver 180 then produces a second input signal for the hearing aid's processing circuitry that may be combined with the input signal produced by the microphone 105 or used in place thereof. It should be appreciated that the companion microphone 200 may typically communicate with a pair of hearing aids 100 worn by the user. A battery 120 supplies power to the hearing aid's components.

As shown in FIG. 1, the companion microphone 200 includes a microphone 205, processing circuitry 201, a wireless radio transmitter 215, and a battery 220 for supplying power to these components. The processing circuitry 201 processes signals generated by the microphone 205 and operates the radio transmitter to wirelessly transmit audio signals picked up by the companion microphone 205 to the wireless receiver 180 of the hearing aid 100. The companion microphone 200 is also equipped with an accelerometer 210 interfaced to the processing circuitry. The accelerometer 210 may be a multi-axis accelerometer for detecting the orientation of the companion microphone relative to gravity as well as detecting movement of the device. As will be described below, the processing circuitry 201 may be configured to use signals generated by the accelerometer 210 to determine a device state which may then be used to adjust a radio transmission power level of the radio transmitter 215.

A battery powered wireless device such as a companion microphone contains a radio and an antenna for wireless communication. When an antenna on a portable device is in the presence of a human body, antenna performance (specifically antenna efficiency) degrades due to RF (radio-frequency) energy absorption from human tissue and body loading causing antenna-radio impedance mismatches. To compensate for this antenna performance degradation, the power of the radio can be increased by an amount that is comparable to the antenna efficiency degradation achieving equivalent wireless performance. However, the increase in radio transmission power comes at the expense of battery life since the radio will draw more current from the battery.

Figure 2A:
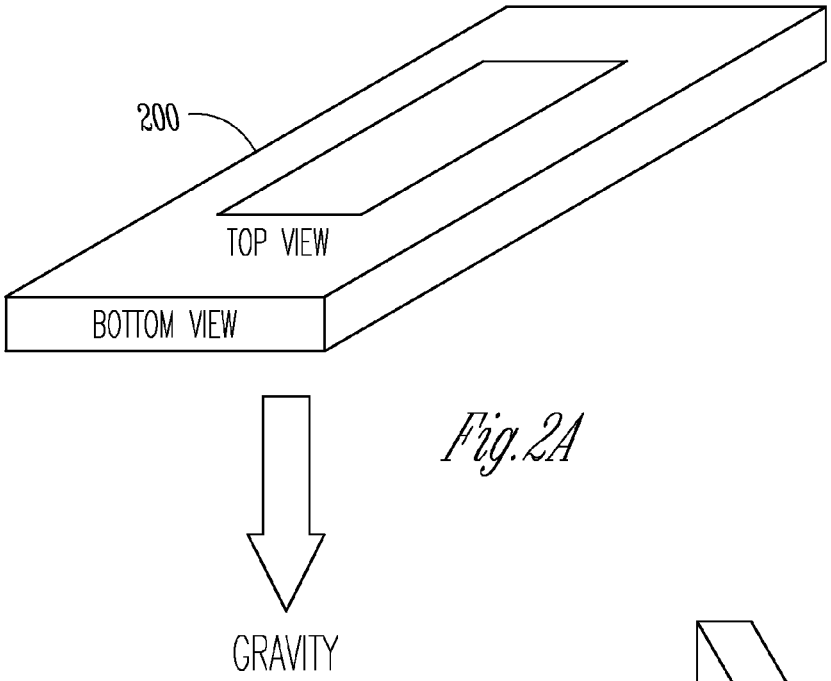
FIG. 2A depicts an example of a low-power mode orientation of the companion microphone.
Figure 2B:
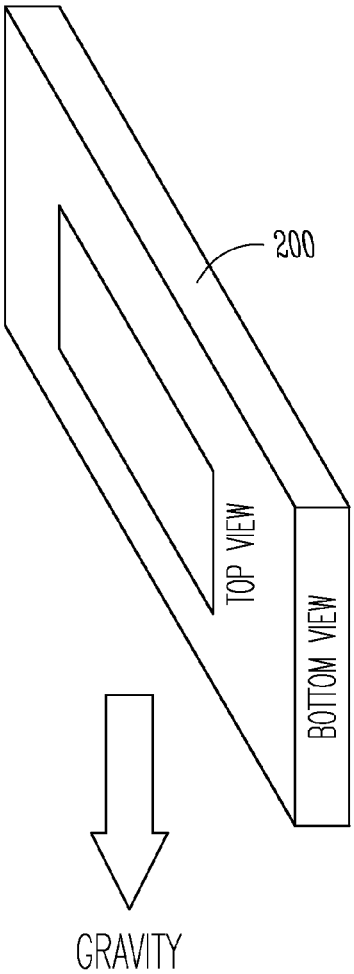
FIG. 2B depicts an example of a high-power mode orientation of the companion microphone.

For a portable device such as the companion microphone (CM), the device can be used in multiple ways. Two common use cases include body-worn (e.g., lapel or lanyard) and off-body (e.g., placed on a stationary structure such as a tabletop). If the device is off-body, no antenna performance degradation will occur from the presence of the human body. If the device is on-body, the antenna performance will be degraded and the radio transmission power must be increases to achieve similar wireless performance to the off-body case, but at the expense of battery life. FIGS. 2A and 2B depict two different orientations of a companion microphone 200 relative to gravity. If the CM orientation is "flat" (see FIG. 2A), it is likely on the table and no increase in radio transmission power is necessary. If the CM is "sideways" or "upright" (see FIG. 2B), it is likely on-body and an increase in radio transmission power is necessary. Since the CM will likely only be on-body a percentage of the overall device battery life, a method for determining the orientation of the device, and using that information to control the radio transmission power will allow for battery life of the device to be increased for many users.

Described herein are schemes help to preserve battery life in a companion microphone by using adaptive radio transmission power control. The transmission power of the radio may be turned up or down as needed based on the orientation and/or movement of the device. Since the radio transmission power is only increased when needed, there is less time average current draw over the life of the battery resulting in a longer life on a single charge. Radio transmission power is thus increased only when needed and decreased when not needed to increase the battery life of the electronic device. In addition to companion microphones for hearing aids, all of the embodiments of the radio transmission power control scheme as described herein may be used to prolong the battery life of any type of body-worn microphone accessory that can be used in on-body and off-body use cases.

Figure 3:
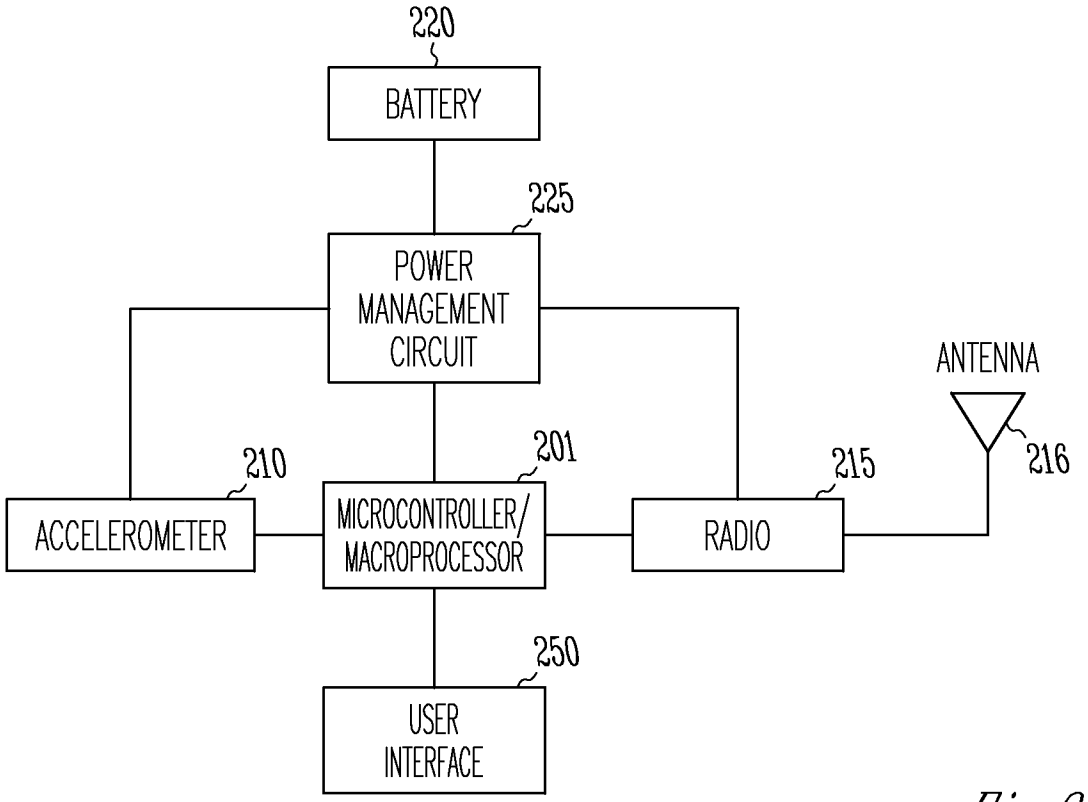
FIG. 3 illustrates an example of circuitry used by the companion microphone to manage its radio transmission power level.

FIG. 3 shows a block diagram of the circuit components of the companion microphone involved in implementing a power control scheme. The circuit components could also generically represent the components of any battery-powered portable electronic device that transmits radio signals. The device is powered with a battery 220 connected to a power management circuit 225. The power management circuit 225 provides DC power to the accelerometer 210, microcontroller/microprocessor 201 (i.e., part of processing circuitry 201), and radio 215 (i.e., the wireless transmitter 215) that is connected to antenna 216. The device has a user interface 250 that facilitates user control of the device. The microcontroller/microprocessor 201 reads state information from the accelerometer 210 and, based upon the information read, sends commands to the radio 215 to adjust the radio transmission power level.

Figure 4:
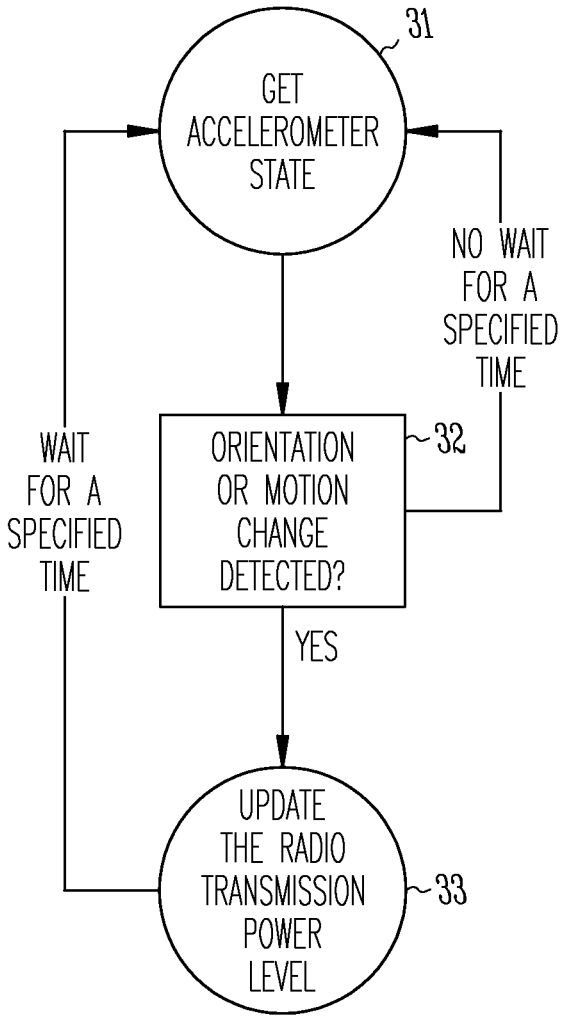
FIG. 4 illustrates an example power control algorithm.

FIG. 4 shows a diagram of an example power control algorithm. The start of the algorithm begins at stage 31 with the microcontroller/microprocessor 201 getting the electronic device orientation and movement state from the accelerometer 210. If no change in the device state is detected relative to the previous state information stored in memory as determined at stage 32, no action is taken and a back-off timer is started. (The timer may be implemented as part of the processing circuitry.) The timer controls the rate at which the state information provided by the accelerometer is sampled and processed. Upon expiration of the back-off timer, the electronic device state information is again retrieved by the microcontroller/microprocessor from the accelerometer at stage 31. If a state change is detected relative to the previous state information stored in memory at stage 32, the microcontroller/microprocessor sends a command to the radio to change the transmission power based on device programming at stage 33. After the radio transmission power has been set, a back-off timer is started. The back-off timer provides the same functionality as described earlier.

Figure 5:
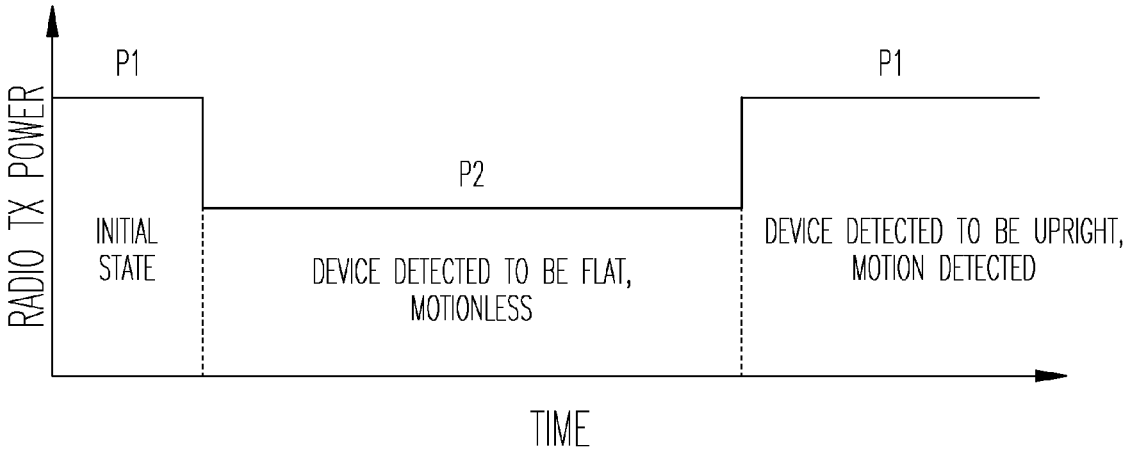
FIG. 5 depicts the level of radio transmission power versus time in a first example scenario.

FIG. 5 plots an example of what the radio transmission power behavior may look like over time with various orientation/movement state changes incurred by the electronic device. As shown in the figure, the radio transmission power level initially starts at level $P_1$. After the device is detected to be flat and motionless, the radio transmission power level is adjusted to level P2, which is lower than Pi. Subsequently, the device is detected to be upright with movement detected. The power level is then increased back to level $P_1$.

To further illustrate the concepts presented in this disclosure, another implementation example will be described. The electronic device illustrated in FIGS. 2A-B may be a wireless companion microphone designed to be worn on the human body. A lapel or shirt clip may be installed on the device for the user to attach the device to their clothing. The position of the clip forces the device to be in one of several predictable orientations when worn on the body. When not worn on the body, the device is likely to be placed flat on a table. This creates a separate set of predictable orientations associated with this use case. Based on the current device orientation detected by the accelerometer, the device position (on- or off-body) may be inferred.

Since there are cases of overlap between these orientation sets, a false trigger is possible (e.g., a device is detected off-body when it is actually on-body). One example is when a user is lying back on a bed or reclined causing the device orientation to resemble FIG. 2A from which it is inferred that the device is off-body. To mitigate this and other cases like it, a movement condition may also be used as criteria for determining whether the device is worn on the body. A detected no-movement condition suggests that the device is off the body. This together with the orientation information provides a high success rate in properly detecting whether the device is worn on the body or not.

Figure 6:
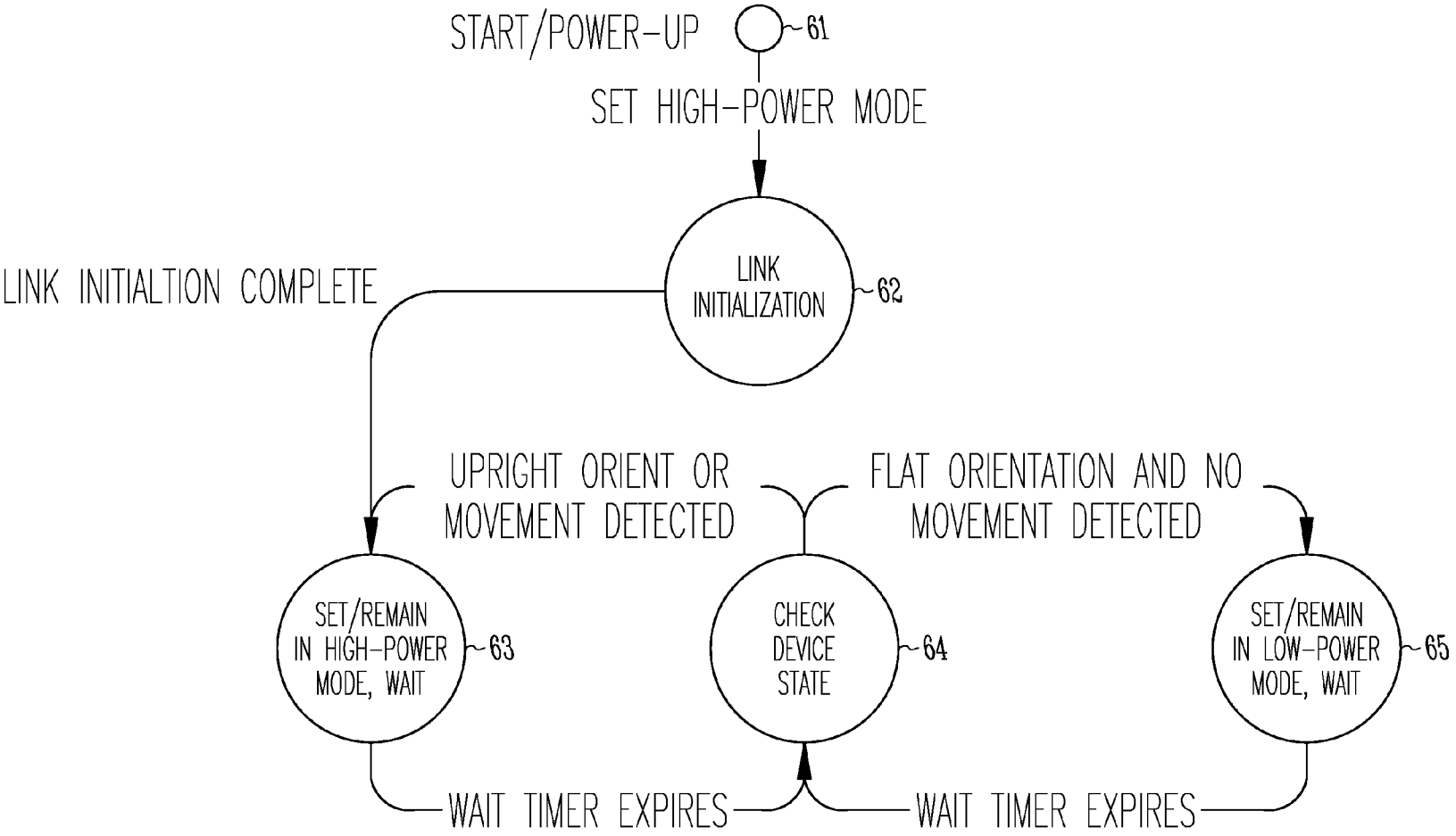
FIG. 6 illustrates an example power control state diagram.

FIG. 6 shows an example state diagram of the power control algorithm for the remote microphone device in this implementation example. Upon power-up at state 61, the device enters high-power mode and initializes the wireless link at state 62. The device remains in high power mode at state 63 for a specified wait time after initialization before obtaining new state information about the device from the accelerometer. Upon expiration of the timer, the device orientation state and movement status is obtained from the accelerometer at state 64. If the orientation illustrated in FIG. 2B is detected or if a movement condition is detected, the device is likely on the human body (handheld, lapel worn, etc) and remains in high-power mode at state 63. However, if the orientation of FIG. 2A is detected and a no movement condition is also detected, the device is likely not being worn on the human body and the radio transmission power can be reduced by a specified ratio at state 65 to save energy.

Figure 7:
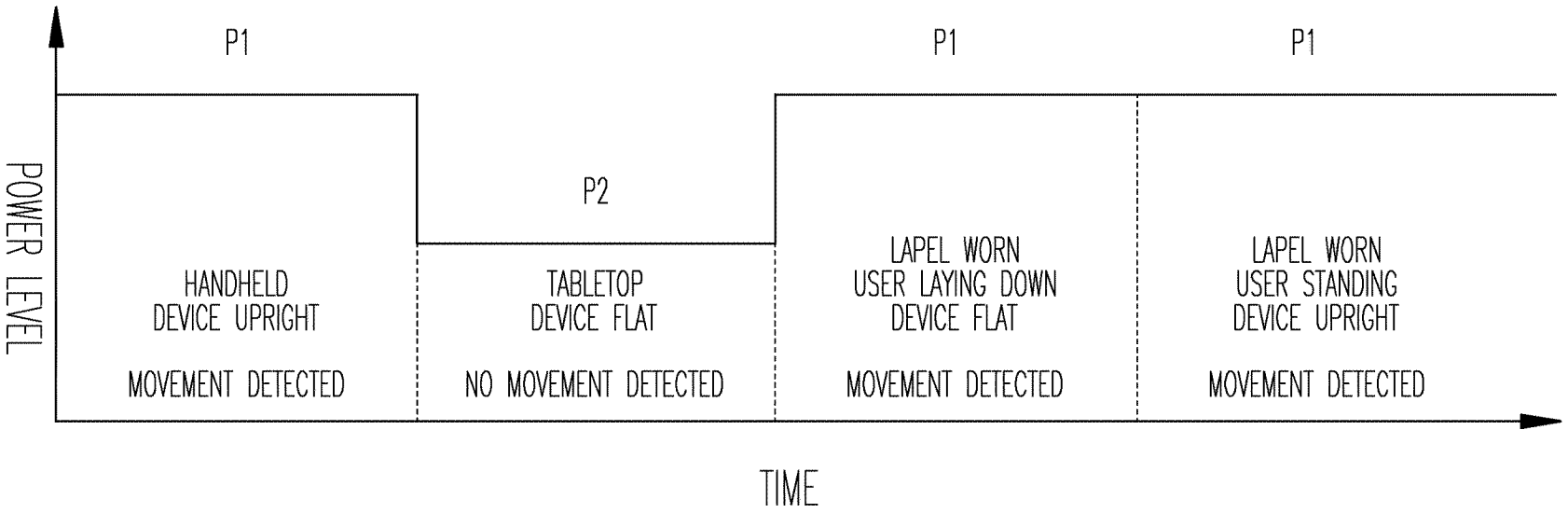
FIG. 7 depicts the level of radio transmission power versus time in a second example scenario.

FIG. 7 illustrates the radio transmission power level versus time for various use cases according to one example embodiment. The device initially operates at power level $P_1$ when either movement is detected or an upright orientation is detected. Subsequently, the device orientation is detected to be flat with no movement detected, and the power level is adjusted to a lower level $P_2$. Subsequently, the device orientation continues to be detected as flat, but movement is detected. The power level is then adjusted back to higher level $P_1$. Subsequently, the device orientation is detected as upright with movement continuing to be detected, and the power level is maintained at level $P_1$.

Example Embodiments

In one embodiment, a companion microphone for a hearing aid comprises: a microphone; processing circuitry for producing an input signal from signals generated by the microphone; a wireless radio transmitter for transmitting the input signal to a wireless receiver of the hearing aid; an accelerometer; a battery and power control circuitry; and, wherein the processing circuitry is configured to adjust the radio transmission power of the wireless transmitter in dependence upon signals generated by the accelerometer.

The processing circuitry may be configured to set the radio transmission power at either a high power level or a low power level in dependence upon signals generated by the accelerometer. The processing circuitry may be configured to determine a device state from the accelerometer signals and set the radio transmission power level according to the device state. The processing circuitry may be configured to determine the device state at periodic intervals as controlled by a timer and to set the radio transmission power level accordingly.

In one embodiment, the device state includes an orientation of the companion microphone relative to gravity as determined from the accelerometer signals. The processing circuitry may be configured to set the radio transmission power level at a high power level if the device state indicates that the companion microphone has an orientation that corresponds to how the companion microphone would be oriented when worn by a user. The processing circuitry may be configured to set the radio transmission power level at a low power level if the device state indicates that the companion microphone has an orientation that corresponds to how the companion microphone would be oriented when placed upon a stationary structure.

In one embodiment, the device state includes detection of movement as determined from the accelerometer signals. The processing circuitry may be configured to set the radio transmission power level at a high power level if the device state indicates that the companion microphone is moving. The processing circuitry may be configured to set the radio transmission power level at a low power level if the device state indicates that the companion microphone is not moving.

In one embodiment, the processing circuitry is configured to: determine a device state from the accelerometer signals, wherein the device state includes an orientation of the companion microphone relative to gravity and whether or not the companion microphone is moving; set the radio transmission power level at a high power level if the device state indicates that the companion microphone is moving; set the radio transmission power level at a high power level if the device state indicates that the companion microphone has an orientation that corresponds to how the companion microphone would be oriented when worn by a user standing or sitting upright; and, set the radio transmission power level at a low power level if the device state indicates that the companion microphone has an orientation that corresponds to how the companion microphone would be oriented when placed upon a stationary structure and no movement is detected;

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A companion microphone for a hearing aid, comprising:

a microphone;

processing circuitry for producing an input signal from signals generated by the microphone;

a wireless radio transmitter for transmitting the input signal to a wireless receiver of the hearing aid;

an accelerometer;

a battery and power control circuitry; and, wherein the processing circuitry is configured to adjust a radio transmission power level of the wireless transmitter in dependence upon signals generated by the accelerometer, wherein the radio transmission power level is reduced when accelerometer signals indicate that microphone is likely not in proximity to the user and the radio transmission power level is increased when accelerometer signals indicate the microphone is likely worn by the user.

2. The companion microphone of claim 1 wherein the processing circuitry is configured to set the radio transmission power at either a high power level or a low power level in dependence upon signals generated by the accelerometer.

3. The companion microphone of claim 2 wherein the processing circuitry is configured to determine a device state from the accelerometer signals and set the radio transmission power level according to the device state.

4. The companion microphone of claim 3 wherein the processing circuitry is configured to determine the device state at periodic intervals as controlled by a timer and to set the radio transmission power level accordingly.

5. The companion microphone of claim 3 wherein the device state includes an orientation of the companion microphone relative to gravity as determined from the accelerometer signals.

6. The companion microphone of claim 5 wherein the processing circuitry is configured to set the radio transmission power level at a high power level if the device state indicates that the companion microphone has an orientation that corresponds to how the companion microphone would be oriented when worn by a user.

7. The companion microphone of claim 5 wherein the processing circuitry is configured to set the radio transmission power level at a low power level if the device state indicates that the companion microphone has an orientation that corresponds to how the companion microphone would be oriented when placed upon a stationary structure.

8. The companion microphone of claim 5 wherein the device state includes detection of movement as determined from the accelerometer signals.

9. The companion microphone of claim 8 wherein the processing circuitry is configured to set the radio transmission power level at a high power level if the device state indicates that the companion microphone is moving.

10. The companion microphone of claim 3 wherein the processing circuitry is configured to:

determine a device state from the accelerometer signals, wherein the device state includes an orientation of the companion microphone relative to gravity and whether or not the companion microphone is moving;

set the radio transmission power level at a high power level if the device state indicates that the companion microphone is moving;

set the radio transmission power level at a high power level if the device state indicates that the companion microphone has an orientation that corresponds to how the companion microphone would be oriented when worn by a user sitting or standing upright; and, set the radio transmission power level at a low power level if the device state indicates that the companion microphone has an orientation that corresponds to how the companion microphone would be oriented when placed upon a stationary structure and no movement is detected.

11. A method for operating a companion microphone for a hearing aid, comprising:

producing an input signal from signals generated by a microphone;

transmitting the input signal to a wireless receiver of the hearing aid via a wireless transmitter;

an accelerometer; and, adjusting a radio transmission power level of the wireless transmitter in dependence upon signals generated by an accelerometer, wherein the radio transmission power level is reduced when accelerometer signals indicate that microphone is likely not in proximity to the user and the radio transmission power level is increased when accelerometer signals indicate the microphone is likely worn by the user.

12. The method of claim 11 further comprising setting the radio transmission power at either a high power level or a low power level in dependence upon signals generated by the accelerometer.

13. The method of claim 12 further comprising determining a device state from the accelerometer signals and set the radio transmission power level according to the device state.

14. The method of claim 13 further comprising determining the device state at periodic intervals as controlled by a timer and setting the radio transmission power level accordingly.

15. The method of claim 13 wherein the device state includes an orientation of the companion microphone relative to gravity as determined from the accelerometer signals.

16. The method of claim 15 further comprising setting the radio transmission power level at a high power level if the device state indicates that the companion microphone has an orientation that corresponds to how the companion microphone would be oriented when worn by a user.

17. The method of claim 15 further comprising setting the radio transmission power level at a low power level if the device state indicates that the companion microphone has an orientation that corresponds to how the companion microphone would be oriented when placed upon a stationary structure.

18. The method of claim 15 wherein the device state includes detection of movement as determined from the accelerometer signals.

19. The method of claim 18 further comprising setting the radio transmission power level at a high power level if the device state indicates that the companion microphone is moving.

20. The method of claim 13 further comprising:

determining a device state from the accelerometer signals, wherein the device state includes an orientation of the companion microphone relative to gravity and whether or not the companion microphone is moving;

setting the radio transmission power level at a high power level if the device state indicates that the companion microphone is moving;

setting the radio transmission power level at a high power level if the device state indicates that the companion microphone has an orientation that corresponds to how the companion microphone would be oriented when worn by a user sitting or standing upright; and, setting the radio transmission power level at a low power level if the device state indicates that the companion microphone has an orientation that corresponds to how the companion microphone would be oriented when placed upon a stationary structure and no movement is detected.

* * * * *